United States Patent [19]

Goutard et al.

[11] 4,281,691

[45] Aug. 4, 1981

[54] DEVICE FOR TRANSFERRING AND PACKAGING CONTAMINANTS SUCH AS RADIOACTIVE PRODUCTS WITHIN A LEAK-TIGHT SHEATH

[75] Inventors: Rene Goutard, Verrieres le Buisson; Raymond Levardon, Paris, both of France

[73] Assignee: Commissariat a l'Energie Atomique, Paris, France

[21] Appl. No.: 66,522

[22] Filed: Aug. 15, 1979

[30] Foreign Application Priority Data

Aug. 25, 1978 [FR] France ..... 78 24625

[51] Int. Cl.[3] ..... G21F 7/00

[52] U.S. Cl. ..... 141/1; 141/98; 141/392; 252/301.1 W; 414/146; 422/903

[58] Field of Search ..... 252/301.1 W; 414/146, 414/221, 217; 141/1, 346, 98, 383, 390, 392; 220/256; 422/903

[56] References Cited

FOREIGN PATENT DOCUMENTS

| | | | |
|---|---|---|---|
| 1301031 | 5/1961 | Belgium | 414/146 |
| 2637859 | 3/1978 | Fed. Rep. of Germany | 252/301.1 W |
| 1024089 | 3/1966 | United Kingdom | 414/146 |
| 1215265 | 12/1970 | United Kingdom | 252/301.1 W |

*Primary Examiner*—Deborah L. Kyle

*Attorney, Agent, or Firm*—Pearne, Gordon, Sessions, McCoy & Granger

[57] ABSTRACT

A contaminating product is packaged within a leak-tight sheath and transferred through a lock-chamber which is rigidly fixed to a leak-tight partition-wall. The device comprises a sleeve having a central cavity for establishing a communication between the lock-chamber and the sheath while ensuring tightness against out-leakage to the environment. A seal plug having a double wall is placed within the cavity for preventing said communication. The seal plug and the sleeve are cut simultaneously in order to close-off the lock-chamber and the sheath separately by means of each wall of the seal plug.

11 Claims, 12 Drawing Figures

DEVICE FOR TRANSFERRING AND PACKAGING CONTAMINANTS SUCH AS RADIOACTIVE PRODUCTS WITHIN A LEAK-TIGHT SHEATH

This invention relates to a device for transferring and packaging of contaminants and especially radioactive products within a leak-tight sheath in such a manner as to ensure that the sequence of operations involved in placing said products within the sheath does not result in any contamination of the environment. The invention is also concerned with a method for the practical application of said device.

In order to be able to transport contaminating products without danger, it is usually necessary to place them within packages which afford total leak-tightness and are protected as far as possible against forcible opening. This presents the problem of the design concept of tight packages and also involves the problem of transfer of contaminating products within these packages without causing any contamination of the environment.

By way of example, contaminating products which give rise to such problems can be radioactive products and especially nuclear fuels which have to be transported to a reprocessing plant after use in nuclear reactors. However, contaminants can also consist of chemically or biologically active products which present a hazard in the event of ingestion or only contact even at small doses.

The aim of the present invention is to produce a device and a method in which simple means are employed for providing an effective solution to the problems mentioned above, whether such problems involve radioactive products, chemical products of biologically active products.

To this end, the invention relates to a device for transferring a noxious product through a lock-chamber which is rigidly fixed to a leak-tight partition-wall and for packaging said product within a leak-tight sheath. Said device essentially comprises a sleeve having a central cavity for establishing a communication between said lock-chamber and said sheath while ensuring tightness against outleakage to the environment, and a seal plug having a double wall and placed within the cavity for preventing said communication, the seal plug and the sleeve being intended to be cut simultaneously in order to seal-off said lock-chamber and said sheath separately by means of each wall of said seal plug.

According to a preferred embodiment of the invention, the sleeve is provided with an external channel at right angles to its axis and the seal plug is provided with an internal channel at right angles to its axis and located between its two walls, said channels being of substantially identical width and normally disposed in the same radial plane. The external surface of the seal plug can be rigidly fixed in leak-tight relation to the internal surface of the cavity formed within the seal plug over the entire periphery of said surface and over a distance extending on each side of said channels and measured parallel to the axis of the sleeve.

According to another distinctive feature of the invention, each wall of the seal plug is provided with a gripping element disposed on the side remote from the sheath when said seal plug is in position within the sleeve.

According to a further distinctive feature of the invention, the sleeve can be joined to the sheath in leak-tight manner at one end and is provided at the other end with an outer annular flange in which is formed a groove for receiving an annular seal which is capable of engaging in leak-tight manner with the internal wall of the lock-chamber. The sleeve can then be provided with an external rib having the same diameter as the annular flange and placed at a predetermined distance from this latter, the external rib being intended to be applied against latch-engagement means associated with the lock-chamber. Preferably in this case, the channel formed in the sleeve is disposed between the external rib and that end of the sleeve which is intended to be joined to the sheath.

The invention also relates to a method for the practical application of the aforesaid device in order to remove noxious products contained in a cell and to transfer said products within a leak-tight sheath through a lock-chamber rigidly fixed to the partition-wall of the cell. Said method essentially comprises the following successive steps:

the unit formed by the leak-tight assembly of the upper portions of a first sleeve 1 and of a first seal plug 8 which closes-off the lock-chamber 12 is withdrawn into the interior of the cell while at the same time introducing that end of a second sleeve which is remote from the sheath, said sleeve being closed-off by a second seal plug 8 and being rigidly fixed to a sheath 2, until the external rib 6 is located within the interior of the lock-chamber 12, in which said rib is maintained by latch-engagement means 14, the unit which closes-off the lock-chamber 12 is fully withdrawn and moved to one side in order to free the lock-chamber orifice which opens into the cell, the second seal plug 8 is withdrawn from the second sleeve 1 into the interior of the cell, then moved to one side in order to free the lock-chamber orifice which opens into the cell, the noxious products which are to be transferred and are contained within the cell are introduced into the sheath 2 which is rigidly fixed to the second sleeve 1, the second sleeve 1 is closed-off by means of the second seal plug 8 by bringing the internal channel 9 of this latter in the same radial plane as the external channel 7 of the second sleeve 1, the second seal plug 8 is rigidly fixed to the second sleeve 1 in leak-tight manner, the unit formed by the second sleeve 1 and by the second seal plug 8 is cut along a radial plane which passes through the channels 7, 9.

The invention will now be described in greater detail with reference to one exemplified embodiment which is given without any limitation being implied and illustrated in the accompanying drawings, wherein.

Figure 2:
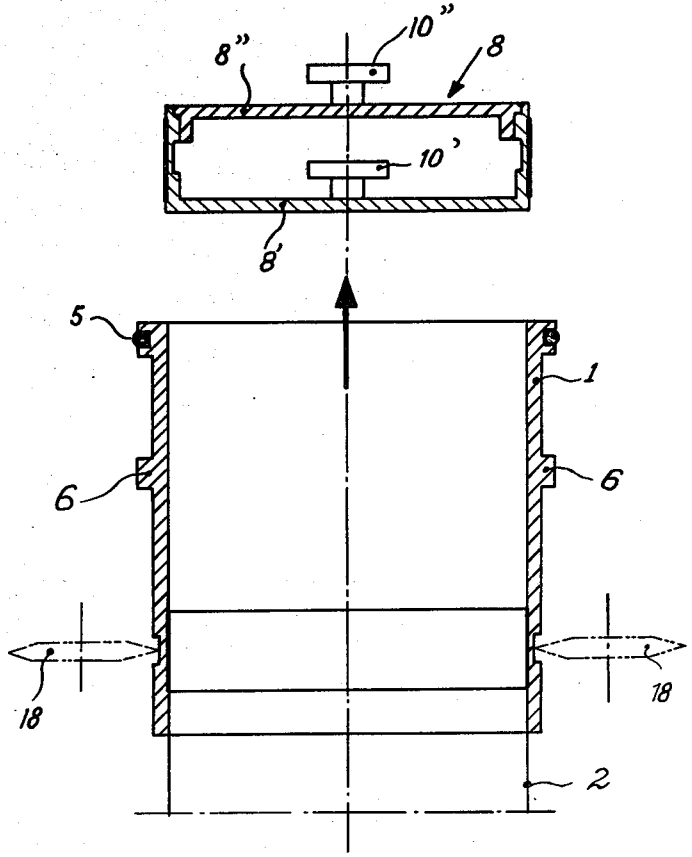
FIG. 2 is a sectional view which is similar to FIG. 1 and shows the device according to the invention but in which the sleeve and the seal plug constituting said device are shown separately.
Figure 1:
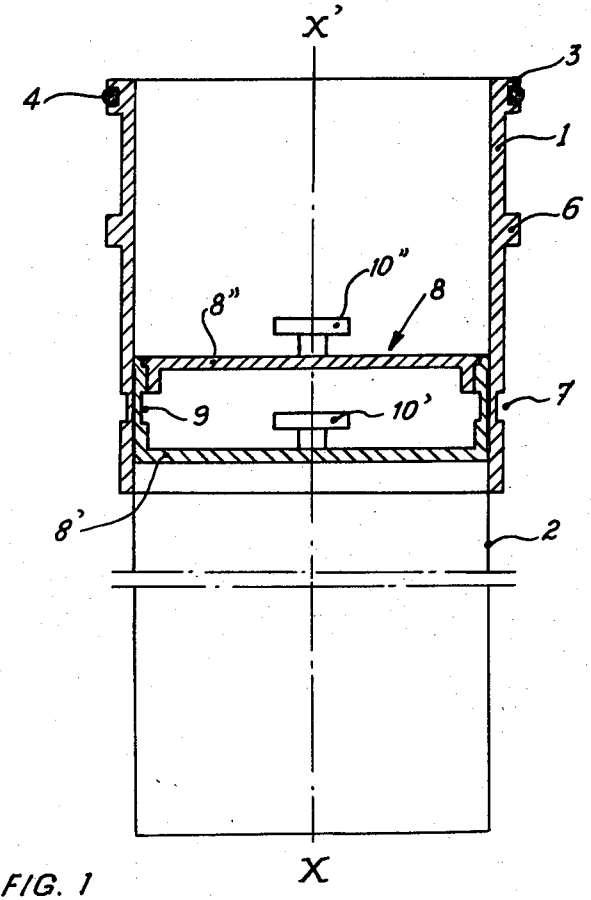
FIG. 1 is a sectional view of the device according to the invention.

In FIGS. 1 and 2, the reference 1 designates a sleeve which is joined to a sheath 2 in a strictly leak-tight manner. In the example shown, the sleeve 1 and the sheath 2 are assumed to be bodies of revolution having the axis of symmetry x—x'. Without departing from the scope of the invention, however, it is possible to devise forms of construction of sleeve and of sheath which are different to those illustrated and which, in particular, may not have symmetry of revolution. In FIG. 1, the wall of the leak-tight sheath 2 for receiving contaminating products to be transferred has been represented only by a thin continuous line since the sheath does not really form part of the device in accordance with the invention. The sheath is mentioned hereinafter only by reason of the strictly leak-tight connection between this latter and the sleeve 1 which, on the contrary, does form part of the device according to the invention.

At the open end remote from the sheath 2, the sleeve 1 is provided with an annular flange 3 which projects radially outwards at right angles to the axis x—x' and in which is formed a groove 4 for receiving a seal 5. Between the annular flange 3 and the sheath 2, the sleeve 1 is provided with an external rib 6 located at right angles to the axis x—x' and having the same external diameter as the annular flange 3. As will become apparent hereinafter, the design function of said external rib 6 is to permit guiding of the sleeve 1 within a cylindrical lock-chamber in cooperating relation with the annular flange 3.

Between the rib 6 and that end of the sleeve 1 which is joined to the sheath 2 is strictly leak-tight manner and at a relatively short distance from said end, the external face of the wall of the sleeve 1 is provided with a channel 7 of predetermined depth, said channel being located at right angles to the axis x—x' of the sleeve. The internal surface of the sleeve which is parallel to the axis x—x' is smooth and cylindrical; in the case of the exemplified embodiment illustrated, said internal surface has a circular cross-section.

Apart from the sleeve 1, the device according to the invention comprises a seal plug 8 having a double wall 8' and 8''. Said seal plug is capable of sliding with slight play within the sleeve 1 along the axis x—x' of this latter which also constitutes the axis of said plug. The internal cavity of the seal plug which is delimited by the two walls 8' and 8'' and by that wall of the plug which is parallel to the axis x—x' is strictly leak-tight.

Between its two walls 8' and 8'', the seal plug 8 is provided on that internal face of its wall which is parallel to the axis x—x' with a channel 9 which is located at right angles to the axis x—x' and has a predetermined depth, the width of said channel being preferably of the same order as the width of the external channel 7 of the sleeve 1.

The seal plug 8 is further provided on each wall 8' and 8'' thereof respectively with a gripping element 10' which projects from that side of the seal plug wall 8' and 8'' which is remote from the sheath 2 when the plug 8 is in position within the sleeve 1. The external peripheral surface of the plug 1 is smooth, cylindrical and parallel to the axis x—x'. Under conditions which will be described hereinafter, said surface can be made integral at all points with the smooth internal face of the sleeve 1 in a strictly leak-tight manner. The leak-tight connection zone thus obtained as measured in the direction of the axis x—x' projects on each side of the channels 7 and 9 formed in the sleeve 1 and in the seal plug 8.

FIGS. 3 to 12 show how the device hereinabove described can be utilized for transferring contaminating products from a first contaminated cell, which is designated in the figures by the reference I and to which members of operating personnel do not normally have access, to a second non-contaminated cell II to which members of personnel do have access.

Figures 3, 4, 5, 6, 7:
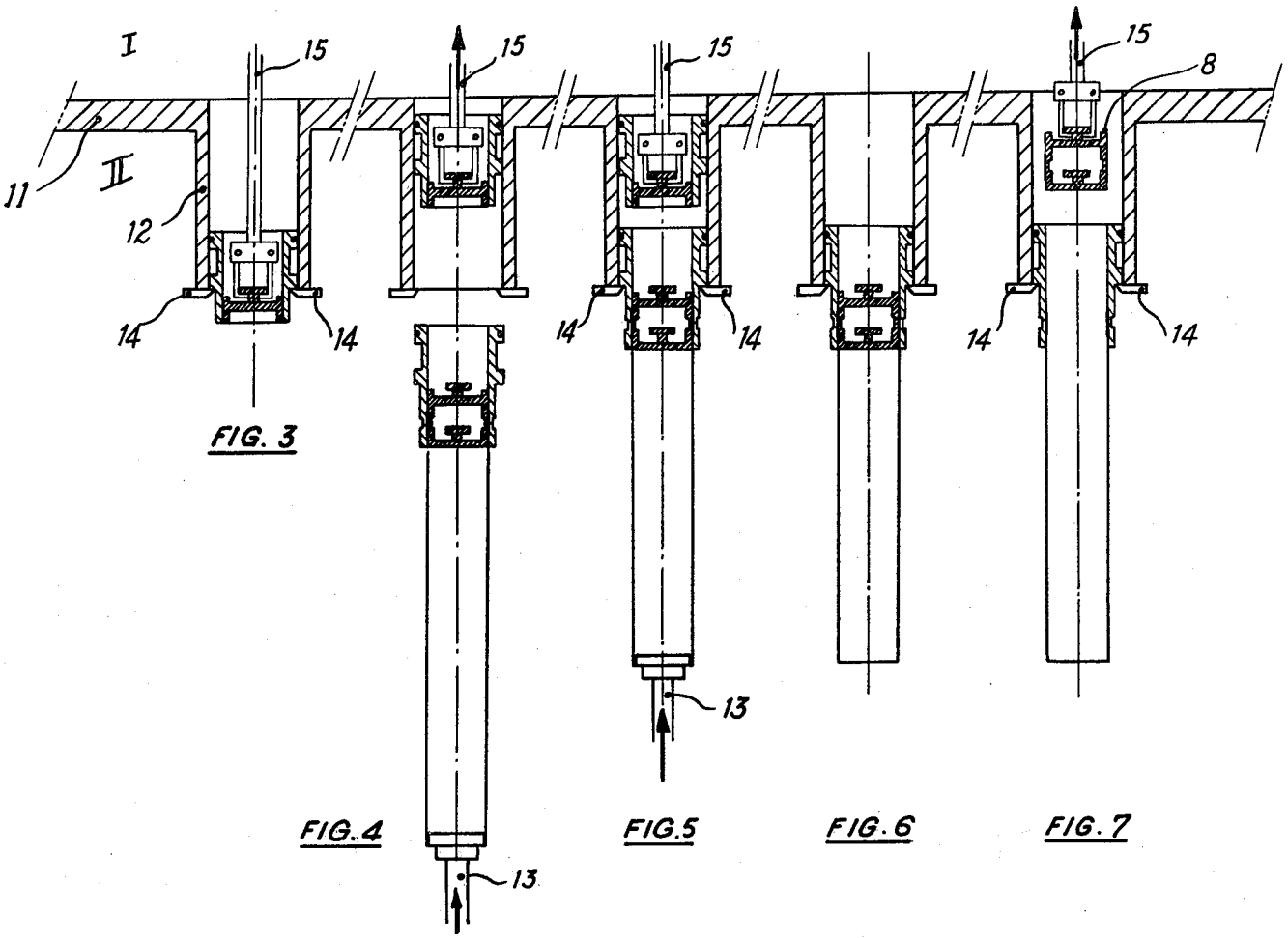
FIGS. 3 to 12 show the different steps of the method according to the invention.

In FIGS. 3 to 4, the cell II is located beneath the cell I, said cells being separated from each other by a leak-tight floor 11. From this floor downwards, a lock-chamber 12 provides a communication between the cell I and the cell II. The inner end of said lock-chamber is sealed-off by a unit formed by the leak-tight assembly of the upper portions of a sleeve 1 and of a seal plug 8. This unit is identical with those described earlier with reference to FIGS. 1 and 2 and was abandoned within said lower end of the lock-chamber 12 at the time of a preceding operation involving transfer of a charge of contaminating products from the cell I into the cell II. Said unit is maintained within the lock-chamber 12 by means of a latch mechanism 14 which cooperates with the external rib 6 of the sleeve 1. In addition, said unit is guided within the lock-chamber 12 on the one hand by the rib 6 of the sleeve 1 and on the other hand by the annular flange 3 of said sleeve whilst the seal 5 placed within the groove 4 of said annular flange also ensures leak-tightness between said annular flange and the internal wall of the lock-chamber 12 and therefore leak-tightness between the cells I and II (as shown in FIG. 3).

Should it be desired to transfer a fresh charge of contaminating products from the cell I into the cell II, an empty sheath 2 is brought into position beneath the lock-chamber 12 within the cell II, said sheath being securely attached to its sleeve 1 in strictly leak-tight manner and fitted with its seal plug 8. The sheath 2 is then vertical and that end of this latter which is remote from the sleeve 1 rests on a lifting device 13 which is not described in detail since it does not form part of the invention (FIG. 4).

By means of said lifting device 13, the sheath 2 is displaced upwards in order to introduce the upper end of the sleeve 1 into the lock-chamber 12. While carrying out this introduction, the unit which is constituted by another sleeve 1 and another seal plug 8 and which was previously abandoned within the lock-chamber 12 is progressively withdrawn at the same time in the upward direction. This withdrawal operation is performed by means of a handling device 15 which is not described in detail since it does not form part of the invention; it need only be mentioned that said handling device operates within the contaminated cell I under remote control from the non-contaminated cell II and is adapted to engage with the gripping element 10'' fixed on the upper portion of seal plug 8 which had previously been left within the lock-chamber 12.

The introduction of the fresh sleeve 1 into the lock-chamber 12 and the upward withdrawal of the previous sleeve 1 are carried out until the external rib 6 of the new sleeve 1 engages with the latch mechanism 14 whilst the new sleeve 1, the sheath 2 to which said sleeve is attached as well as the new plug 8 associated with these latter subsequently remain suspended from the lock-chamber 12 by means of said latch mechanism 14, even if the lifting means 13 are then withdrawn (FIG. 5).

The upward withdrawal of the unit constituted by the upper portions of the previous sleeve 1 and of its seal plug 8 is then continued by means of the handling device 15. When this unit has been fully extracted from the lock-chamber 12, said unit is then drawn to one side within the cell I and again by means of the handling device 15 in order to free the entrance of the lock-chamber 12 (as shown in FIG. 6).

The next stage consists in withdrawing the fresh seal plug 8 from the fresh sleeve 1 which has just been introduced into the lock-chamber 12, in passing said seal plug through the lock-chamber 12, then in drawing it to one side within the cell I in order to free the entrance of the lock-chamber. These operations are also performed by means of the handling device 15 which engages with the element 10'' for gripping the fresh sleeve 1 (as shown in FIG. 7).

Again by means of the handling device 15, a container 16 in which is placed the charge of contaminating products to be transferred is brought into position within the contaminated cell I above the lock-chamber 12. Said container is then passed through said lock-chamber 12, through the sleeve 1, and finally deposited within the sheath 2. In order to carry out this handling operation, the handling device 15 is engaged with a gripping element placed at the top end of the container 16 (as shown in FIG. 8).

The seal plug 8 is then replaced within the sleeve 1 while maintaining it by means of the handling device 15 in a position in which the channels 7 and 9 of the sleeve 1 and of the seal plug 8 are in coincident relation. In this position, and by means of a device shown diagrammatically at 17 in FIG. 20, the external surface of the seal plug 8 and the internal surface of the sleeve 1 are made integral with each other at all points over a distance which extends beyond the channels 7 and 9 on each side of these latter in the vertical direction in order to ensure total leak-tightness between these surfaces over the entire zone under consideration.

Figures 8, 9, 10, 11, 12:
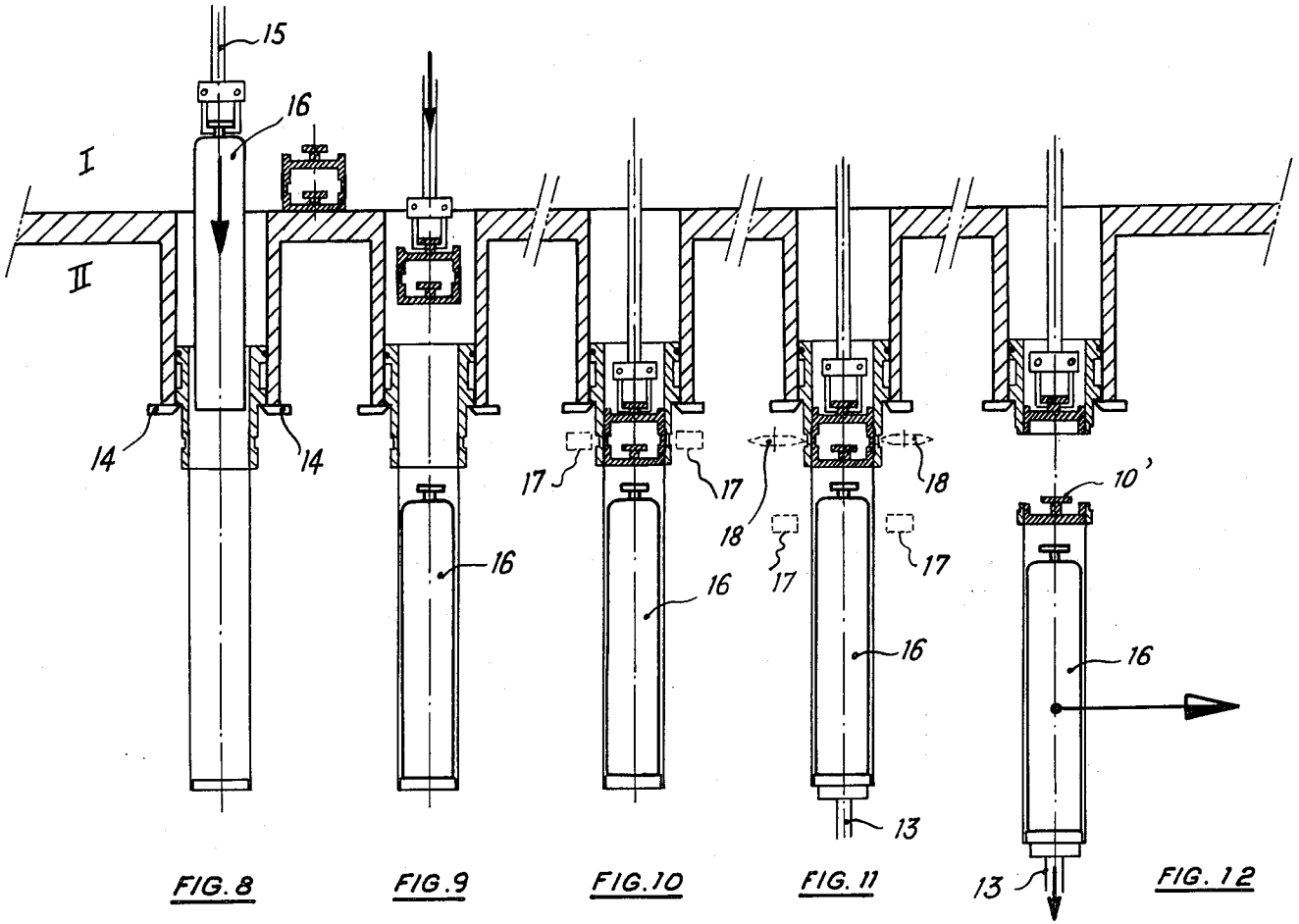

After the lifting device 13 has been returned to its position beneath the sheath 2, the final step consists in cutting the assembly formed by the sleeve 1 and the seal plug 8 to which said sleeve is attached, at the level of the channels 7 and 9 (as shown in FIG. 11). By means of the lifting device 13, it is then possible to lower the sheath 2 which holds the container 13, then to transfer the unit formed by the sheath 2 and the sleeve 1 by engagement of handling means (not shown) with the gripping element 10'. A sheath unit which is equipped in this manner can accordingly be moved away to transportation means which serve to direct the sheath unit to a plant for reprocessing the contaminating products placed within the container 16.

When the different transfer steps have thus been completed, there remains within the lock-chamber 12 an assembly which is maintained in position by the latch mechanism 14 and which is constituted by the upper portion of the sleeve 1 and the upper portion of the seal plug 8, leak-tightness between the cell I and the cell II being ensured by the seal 5 of the annular flange 3.

The means employed for forming an intimate and strictly leak-tight connection between the internal surface of the sleeve 1 and the external surface of the seal plug 8 vary according to the materials employed.

Thus in the case in which the sleeve 1, the sheath 2 and the seal plug 8 are of metal and especially of steel, the surfaces can be joined together by means of a brazing process. The internal wall of the sleeve 1 as well as the external wall of the seal plug 8 are each coated in the hot state with a homogeneous layer of brazing alloy which adheres to said surfaces. Said layers are then ground so as to permit introduction of the seal plug 8 into the sleeve 1 with provision for a small clearance. In order to form an intimate and strictly leak-tight bond at all points between the internal surface of the layer of brazing alloy which has been deposited on the sleeve and the external surface of the layer of brazing alloy which has been deposited on the seal plug when this latter is placed within the sleeve in the position shown in FIG. 10, the brazing alloy is caused to melt by means of eddy currents which circulate within said alloy, said eddy currents being set up by means of a high-frequency magnetic field produced by a loop located outside the sleeve 1. After interruption of the high-frequency field, the brazing alloy again solidifies, thus forming a totally leak-tight connection at all points between the sleeve and the seal plug. By making use of a sleeve 1, a sheath 2 and a steel plug 8 as well as a leak-tight brazed joint, the design solution just described is particularly well suited to the transfer of radioactive products which can be at a relatively high temperature.

Instead of a brazed joint, it is also possible in this case to contemplate a connection by magnetoforming which consists in swaging or deforming the sleeve 1 onto the seal plug 8 at the level of the channels 7 and 9 by means of a powerful magnetic field, the loop 17 being replaced in this case by magnetizing windings. By means of this mode of operation, a joint which affords total leak-tightness at all points is also formed between the two surfaces on condition that these latter have been carefully ground beforehand. This avoids the need for an initial deposit of a layer of brazing alloy on both surfaces.

On the other hand, if the sleeve 1, the seal plug 8 and even the sheath 2 are of non-magnetic materials such as plastic, for example, other means such as bonding by adhesive, ultrasonic welding and so forth can be applied in order to form a joint which is leak-tight at all points between the sleeve 1 and the seal plug 8.

Cutting at the level of the channels 7 and 9 of the rigidly coupled assembly constituted on the one hand by the sleeve 1 and the sheath 2 and on the other hand by the seal plug 8 can be carried out by any suitable means for providing a well-defined and smooth cutting plane such as, for example, cutting wheels 18 as shown diagrammatically in FIGS. 2 and 11. These cutting means do not form part of the invention.

As has been noted in the foregoing, the device and method according to the invention make it possible to transfer contaminating products from a contaminated cell I into a non-contaminated cell II in such a manner as to ensure that the contamination of transferred products or the contamination of the cell I is in no way liable to propagate outside said cell. After cutting of the sleeve 1 and of the seal plug 8 at the level of the channels 7 and 9, any possible contamination is localized on a circumference in the cutting plane, at the joint interface between the sleeve 1 and the seal plug 8. This possible contamination (which is strictly superficial and of low value) can then be removed by conventional decontamination means which are well-known per se.

As can readily be understood, the invention is not limited to the examples of construction mentioned in the foregoing description. For example, the relative arrangement of the sheath and of the sleeve or the relative arrangements of the cells I and II as well as the shapes of the sheath, of the sleeve and of the seal plug can be varied without thereby departing either from the scope or the spirit of the invention.

We claim:

1. A device for transferring a noxious product through a lock-chamber which is rigidly fixed to a leak-tight partition-wall and for packaging said product within a leak-tight sheath, wherein said device comprises a sleeve having a central cavity for establishing a communication between said lock-chamber and said sheath while ensuring tightness against outleakage to the environment, and a seal plug having a double wall, said seal plug being adapted to be slidably introduced within said cavity and means being provided to lock and seal said seal plug within said cavity for preventing said communication, simultaneous cutting of the seal plug and the sleeve operating to separately seal-off said lock-chamber and said sheath by means of each wall of said seal plug.

2. A device according to claim 1, wherein the sleeve is provided with an external channel at right angles to its axis and wherein the seal plug is provided with an internal channel at right angles to its axis and located between its two walls, said channels being of substantially identical width and normally disposed in the same radial plane, said means to lock and seal the seal plug within the cavity providing a connection between the external surface of the seal plug and the internal surface of the cavity which extends over the entire periphery of said surfaces and over a given distance on each side of said channel, said distance being measured parallel to the axis of said sleeve.

3. A device according to claim 1, wherein each wall of the seal plug is provided with a gripping element disposed on the side remote from the sheath when said seal plug is in position within the sleeve.

4. A device according to claim 1, wherein the sleeve can be joined to the sheath in leak-tight manner at one end and is provided at the other end with an outer annular flange in which is formed a groove for receiving an annular seal which is capable of engaging in leak-tight manner with the internal wall of the lock-chamber.

5. A device according to claim 4, wherein the sleeve is also provided with an external rib having the same diameter as the annular flange and placed at a predetermined distance from said flange, said rib being intended to be applied against latch-engagement means associated with the lock-chamber.

6. A device according to claim 5, wherein the channel formed in the sleeve is disposed between the external rib and that end of the sleeve which is intended to be joined to the sheath.

7. A method of removing noxious products contained in a cell and transferring said products to a leak-tight sheath through a lock-chamber rigidly fixed to the partition-wall of said cell, wherein said lock-chamber is provided with a leak-tight assembly including the upper portions of a first sleeve and a first seal plug which closes off the lock-chamber, said method comprising the steps of:

(a) withdrawing said first sleeve into the interior of said cell while at the same time introducing the end of a second sleeve into the end of said lock-chamber remote from the cell, said second sleeve being closed off by a second seal plug and being rigidly fixed to a sheath, continuing the introduction of said second sleeve until an external rib is located within the interior of the lock-chamber and is maintained by latching means;

(b) removing said first sleeve and plug from said lock-chamber in order to open said second sleeve to said cell;

(c) withdrawing the second seal plug from the second sleeve into the interior of the cell in order to open said sheath to said cell;

(d) transferring the noxious products from within said cell into said sheath;

(e) inserting said second plug into said second sleeve;

(f) rigidly fixing said second seal plug in said second sleeve in a leak-tight manner; and (g) cutting said second sleeve and said second plug along a plane which passes between spaced walls on said plug to separate said sheath from said lock-chamber.

8. A method according to claim 7, wherein the second seal plug is rigidly fixed to the second sleeve in leak-tight manner by forming in the hot state a brazed joint between the contacting surfaces of the seal plug and of the sleeve, said surfaces having previously been coated with a layer of brazing alloy.

9. A method according to claim 7, wherein the second seal plug is rigidly fixed to the second sleeve in leak-tight manner by swaging said sleeve against said seal plug by magnetoforming.

10. A method according to claim 7, wherein the second seal plug is rigidly fixed to the second sleeve in leak-tight manner by forming a welded joint by the ultrasonic welding technique.

11. A method according to claim 7, wherein the second seal plug is rigidly fixed to the second sleeve in leak-tight manner by forming a hot-state bond between the two contacting surfaces of said seal plug and of said sleeve, said surfaces having previously been coated with a layer of adhesive.

* * * * *